US005117904A

United States Patent [19]

Bond

[11] Patent Number: 5,117,904

[45] Date of Patent: Jun. 2, 1992

[54] HEAT EXCHANGER

[76] Inventor: William H. Bond, 452 Van Dyke Ave., Del Mar, Calif. 92014

[21] Appl. No.: 730,065

[22] Filed: Jul. 15, 1991

[51] Int. Cl.[5] ..... F28F 7/10

[52] U.S. Cl. ..... 165/159; 165/156; 165/163

[58] Field of Search ..... 165/156, 159, 160, 163

[56] References Cited

U.S. PATENT DOCUMENTS

| | | | |
|---|---|---|---|
| 1,776,135 | 9/1930 | Smith | 165/156 X |
| 1,893,484 | 1/1933 | Belt | 165/163 X |
| 2,428,993 | 10/1947 | Reichelderfer | 165/156 |
| 2,479,071 | 8/1949 | Henstridge | 165/163 X |
| 3,306,352 | 2/1967 | Curren | 165/163 |
| 3,335,790 | 8/1967 | Asanyi et al. | 165/163 X |
| 3,400,758 | 9/1968 | Lee | 165/159 |
| 3,513,908 | 5/1970 | Singh | 165/163 X |
| 3,921,708 | 11/1975 | Brenner | 165/84 |
| 4,063,589 | 12/1977 | Battcock | 165/163 X |

*Primary Examiner*—Allen J. Flanigan
*Attorney, Agent, or Firm*—Max Geldin

[57] ABSTRACT

A cross-flow heat exchanger comprising according to a preferred embodiment a shell formed of two concentric cylinders providing an annular space. A number of tubes and baffles are arranged in the annular space such that one fluid flows through the tubes in a helical fashion in the annular space and the second heat exchange fluid flows in a counter helical path in such annular space across the tubes, constrained by the baffles in such annular space. In another embodiment cross-flow is also achieved using spirally shaped tubes and spirally shaped baffles.

18 Claims, 2 Drawing Sheets

FIG. 1
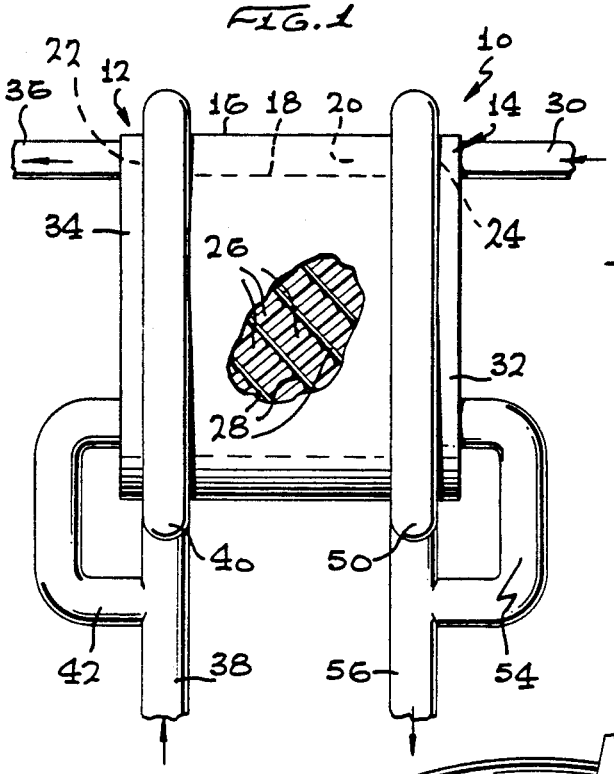
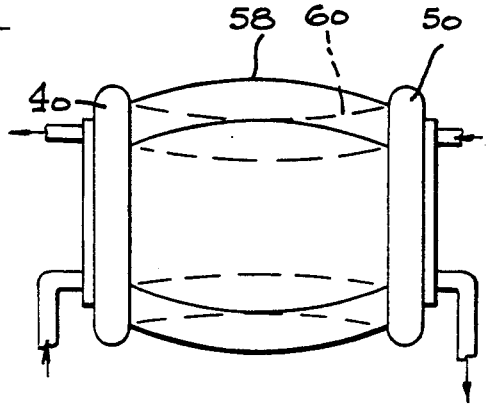
FIG. 5
FIG. 6
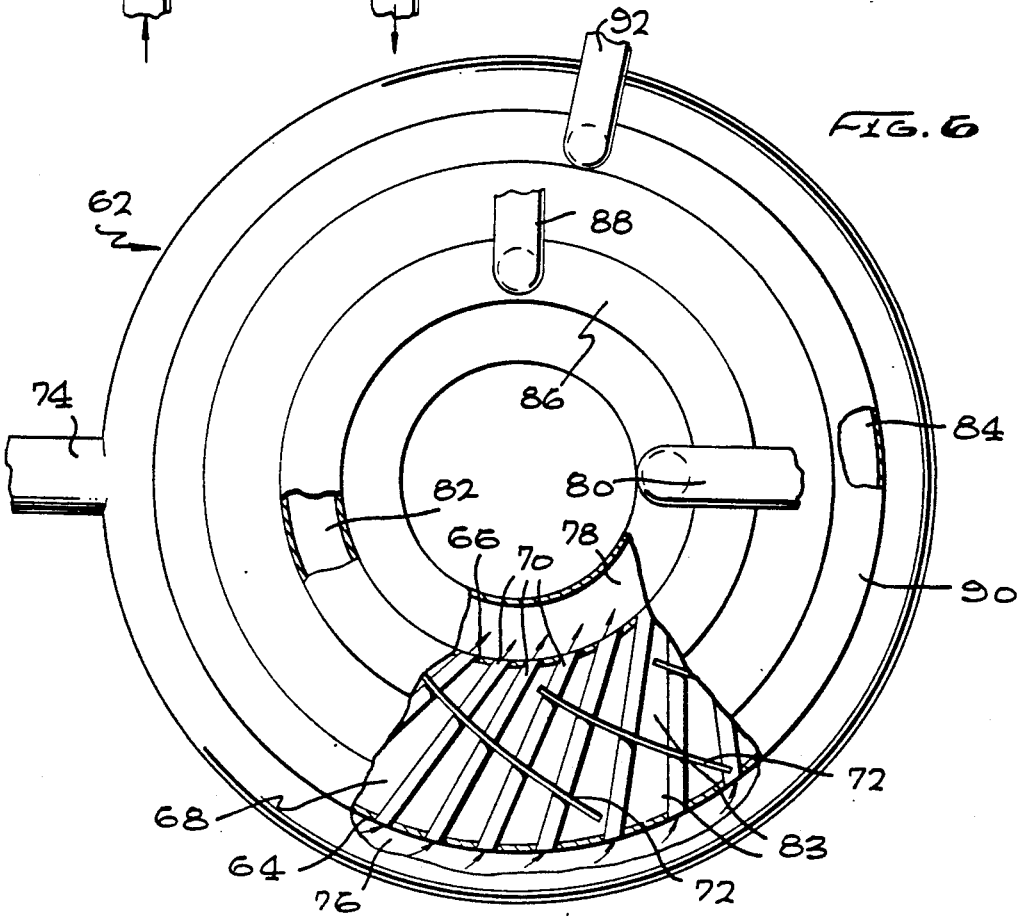

HEAT EXCHANGER

BACKGROUND OF THE INVENTION

This invention relates to heat exchangers, and is more particularly directed to a class of improved heat exchangers designed to realize the maximum transfer of heat with a minimum of heat transfer surface area and pressure loss in the fluids flowing therein.

In order to attain maximum thermodynamic performance, shell and tube or plate-fin type heat exchangers often employ many passes of cross flow stages in order to approach pure thermodynamic temperature distribution. The arrangement of Bond and Yi et al described in U.S. Pat. No. 4,962,810 yields the benefits of many passes in a compact, low pressure-drop design. The patent discloses a multipass heat exchanger comprising an arrangement of a plurality of heat exchanger modules, each module having a plurality of passes for passage of a first heat exchange fluid and a plurality of tubes across such passes for passage of a second heat exchange fluid. The heat exchanger modules are disposed in side-by-side relation, with each successive module adjoining the previous module in a stepped relation, the second exchanger module being positioned relative to the first module so that the first heat exchanger fluid leaving the first pass of the first heat exchanger module enters directly the second pass of the second module, and so on, in a straight through fashion, for as many passes as desired. The result is a highly efficient multipass heat exchanger of minimum weight and pressure loss in the flow path on the shell side of the exchanger, comprised of multiple heat exchanger units, with no reversal of flow in each pass in each exchanger unit.

U.S. Pat. No. 4,501,320 to Lipets et al discloses a multiflow tubular air heater employing a two-pass heat exchange concept embodying a Z-type bypass conduit. Other illustrative prior art heat exchangers are disclosed in U.S. Pat. Nos. 2,002,763; 2,327,491; 2,487,626; 3,180,406; and 4,559,996.

It is accordingly an object of this invention to provide a shell and tube type heat exchanger with essentially cross flow that has a configuration that yields the uniform temperature difference advantages of a pure counterflow design.

Another object of this invention is to eliminate the additional ducting at 40, 42 and 44 in the system of above U.S. Pat. No. 4,962,810 in order to "close" the flow circuits of the end modules in that system.

Another object is to provide a configuration compatible with gas turbine designs that has simple headers desirable as a wraparound regenerator for a gas turbine engine or heat exchanger in conjunction with a turboexpander device.

Yet another object is the provision of a basic heat exchanger design that can be optimized to provide minimum pressure drop for the service required by eliminating bends between passes and eliminating all headers and manifolds except for the inlet and outlet.

A further object is the employment of curved tubes and plates or baffles that relieve thermal stresses and the use of a cylindrical or barrel shaped case for said tubes and baffles to minimize thermal stresses and efficiently contain high internal pressure, these parameters being of particular importance during rapid thermal, flow, and pressure transients.

SUMMARY OF THE INVENTION

According to the invention, an efficient cross-counterflow heat exchanger is provided comprising a system of curved tubes and a system of curved baffles crossing the tubes within an annulus so that respective heat exchange fluids flow in a curved path through the tubes and in a curved crossing path defined by the baffles within the annulus in counter-flow heat exchange relation and in opposite directions.

According to a preferred embodiment, by arranging the tubes and baffles of a cross-flow heat exchanger in a cylindrical annulus, such that one fluid flows through tubes in a helical fashion in this annular space and the second fluid flows in a counter helical path across the tubes, constrained by baffles in the annulus, the effect of pure counterflow temperature distribution is obtained while maintaining good flow distribution and small pressure drop. The same advantages are obtained for a spiral arrangement rather than a helical one.

More particularly, according to such preferred embodiment, a number of tubes are configured in a helical fashion to conform to a cylindrical annulus formed between two concentric cylinders. These tubes are attached and sealed at each end to parallel tubesheets that form the inner sides of the tube-side manifolds at each end of the exchanger. Suitable ducting means delivers the tube-side fluid to the tube-side inlet manifold and removes tube-side fluid from the tube side exit manifold.

The shell-side fluid enters the annular space formed by the two concentric cylindrical shells from either or both of inner and outer shell-side inlet manifolds. The shell-side fluid is constrained by baffles within the annulus to flow in a helical manner across the tubes and in a direction which is opposite from tubesheet to tubesheet than the tube-side fluid. The shell side fluid emerges from the annulus into the shell-side exit inner and/or outer manifolds and is removed from the heat exchanger through suitable ducting.

In many prior art cross flow heat exchanger designs there is a departure from the ideal temperature difference between the hot and cold fluids which results in reduced performance. The present invention seeks to approach pure counter-flow temperature differences while retaining the advantages of high cross-flow heat transfer coefficients, minimum volume and low pressure loss.

BRIEF DESCRIPTION OF THE DRAWINGS

FIG. 1 is a side elevation, partly broken away, of a heat exchanger according to the invention;

FIG. 5 illustrates a modified feature of the invention; and

FIG. 6 is a front view, partly broken away, of a modified form of heat exchanger of the invention.

DETAILED DESCRIPTION OF THE INVENTION AND PREFERRED EMBODIMENTS

Figure 2:
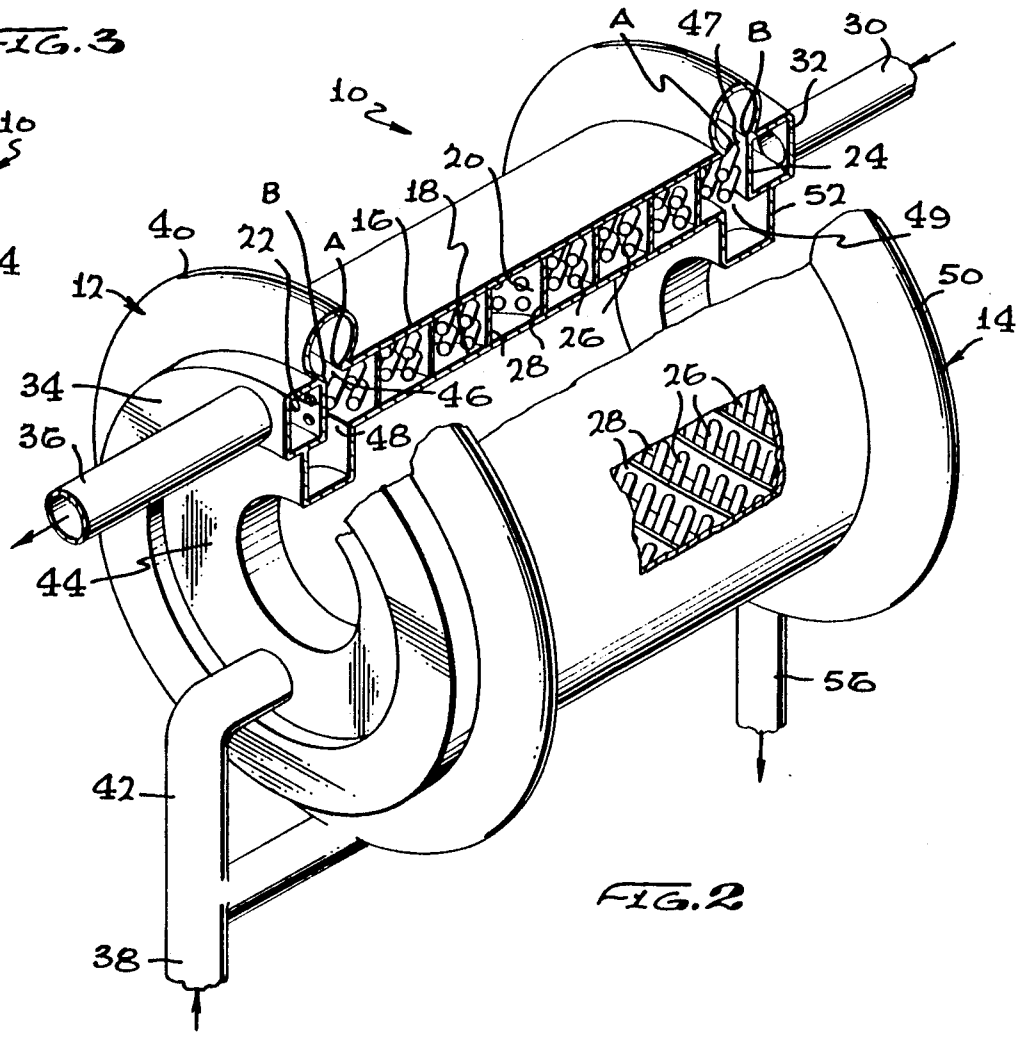
FIG. 2 is a perspective side elevation of the heat exchanger of FIG. 1, partly broken away to show the relation of the tubes and baffles within the heat exchanger.
Figure 3:
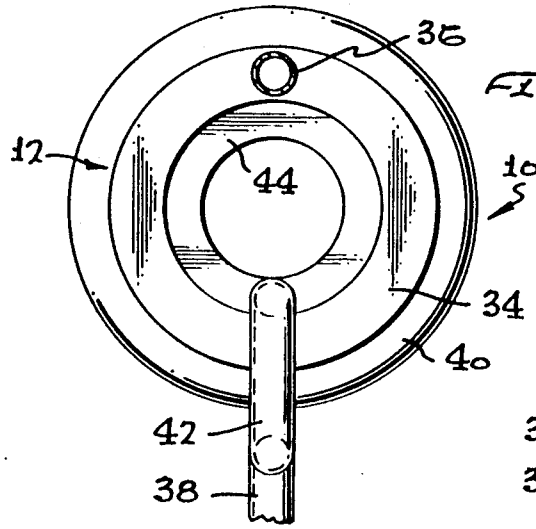
FIG. 3 is a front view of the heat exchanger of FIG. 1.
Figure 4:
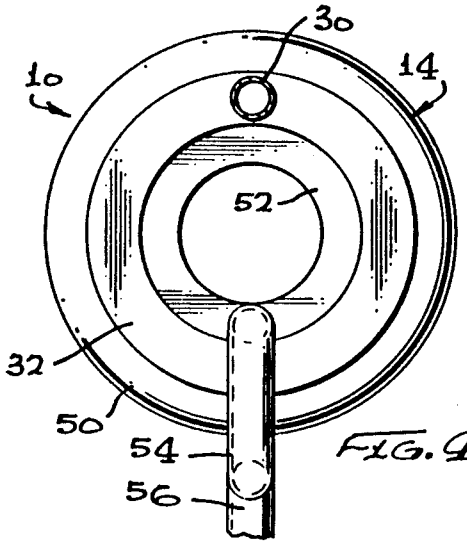
FIG. 4 is a rear view of the heat exchanger of FIG. 1.

Referring to FIGS. 1 to 4 of the drawing, numeral 10 illustrates a preferred form of heat exchanger according to the invention, numeral 12 indicating the hot end of the exchanger and 14 the cold end.

The heat exchanger body is formed of two concentric cylinders, an outer cylinder or shell 16 and an inner cylinder 18 of substantially smaller diameter than the outer shell. The concentric cylinders 16 and 18 form an annulus 20 therebetween. Closing the opposite ends of the annulus 20 are a pair of ring-shaped tubesheets 22 and 24 located near the ends of the concentric cylinders 16 and 18, 22 being the hot end tubesheet and 24 the cold end tubesheet.

A number of closely spaced tubes 26 extend helically in the annulus 20 to permit flow of heat exchange fluid in one direction helically around the axis of the cylindrical annulus, the tubes being attached and sealed at their opposite ends to the parallel tubesheets 22 and 24.

A number of equally spaced and parallel baffles 28 are also positioned in the annulus 20 and extend helically in the annulus to constrain flow of a second heat exchange fluid helically across the tubes 26 and in the opposite direction around the axis of the cylindrical annulus. The baffles 28 each have a depth extending from the outer cylinder 16 to the inner cylinder 18 of annulus 20, and the tubes 26 cross and pass through the baffles at approximately a 90° angle. The baffles 28 extend almost the entire length of the cylinders 16 and 18. Gaps or slots 46 and 48 between the ends of the cylinders 16 and 18 and the tubesheets 22 and 24 permit the shell side fluid to pass from the shell side inlet manifolds 40 and 44 into the annulus 20 and similar gaps or slots 47 and 49 permit passage of the shell side fluid out of the annulus into the shell side exit manifolds 50 and 52 at the opposite end, as described further hereinafter.

Suitable ducting means (not shown) delivers the cold tube-side fluid, e.g. cold water, to an inlet 30 and into a tube-side inlet manifold 32 which covers the outside of tubesheet 24 and thus delivers the cold fluid to the inlet ends of the tubes 26 at the cold end of the heat exchanger.

Heated tube-side fluid passing through the helical tubes 26 is discharged from the tubesheet 22 into a tube-side outlet or exit manifold 34 covering the outer side of tubesheet 22, and the hot fluid is removed through the tube-side outlet 36.

The hot shell-side fluid, e.g. hot water, is delivered to an inlet 38 and a portion of such fluid passes into an outer shell-side ring shaped inlet manifold 40 while another portion of the hot shell-side fluid passes through a duct 42 which discharges into an inner shell-side ring shaped inlet fluid manifold 44. The hot shell-side fluid flows from the outer shell-side inlet manifold 40 through a circular opening 46 in the outer cylinder 16 into the annular space 20 between the two concentric cylinders 16 and 18, and the hot shell-side fluid also flows from the inner shell-side inlet manifold 44 through a circular opening 48 in the inner cylinder 18 into the annular space 20. The shell-side fluid in annulus 20 is constrained by the baffles 28 to flow in a helical manner between adjacent baffles across the tubes 26 carrying the cold tube side fluid, and in an axial direction which is opposite from tube sheet 22 to tubesheet 24 than the flow of tube-side fluid.

The now cooled shell-side fluid is discharged from circular openings 47 and 49 at the cold end of the heat exchanger, similar to circular openings 46 and 48 at the hot end of the exchanger, into an outer ring shaped shell-side exit manifold 50, similar to 40, and an inner shell-side outlet manifold 52, similar to 44, and the combined shell-side fluid is removed from the heat exchanger through duct 54 and outlet 56.

It is seen that the shell side helical flow of one heat exchange fluid actually crosses the tube side helical flow of the other heat exchange fluid in effectively a counter-flow manner. Due to symmetry, on any plane normal to the axis of the helix, the temperature of the shell-side fluid is constant, and also the temperature of the tube-side fluid is constant at a different value. There is a smooth variation in the temperature of each fluid in the axial direction of the heat exchanger from one end to the other. This characteristic eliminates the uneven temperature distributions found in conventional multipass heat exchangers and contributes to the more efficient transfer of heat.

Because of the use of curved tubes, baffles and shells, this design exhibits superior resistance to failure due to thermal stresses, particularly caused due to transient flow and temperature spikes.

To further accommodate temperature differences with minimum stress, one or both of the cylindrical shells 16 and 18 can be made barrel shaped, as indicated at 58 in FIG. 5, or inverse barrel shaped, as indicated by dotted lines 60 in FIG. 5, to provide another degree of freedom for relative expansion or contraction. The term "substantially cylindrical" with respect to the outer and inner cylindrical shells, is accordingly intended to denote either truly cylindrical or barrel shaped or inverse barrel shaped outer and inner shells as disclosed herein.

Further, instead of employing both inner and outer shell-side inlet manifolds 44 and 40, a single inner or a single outer shell-side inlet manifold can be employed, and instead of both inner and outer shell-side exit manifolds 52 and 50, a single inner or a single outer shell-side exit manifold can be employed. Thus, either one of these shell-side inlet and shell-side outlet manifolds or dual shell-side inlet and shell-side exit manifolds, as shown, can be used depending on the particular application. However, the use of two shell-side inlet manifolds and two shell-side outlet manifolds is preferable in reducing pressure losses and to improve the flow distribution.

Further, it is recognized that the annulus size and tube size and spacing may be varied along the cylindrical axis to provide more optimum flow and heat transfer, particularly when gases are being heated or cooled through large temperature and density ranges.

In the embodiment shown, the helical baffles extend between axial positions A—A in FIG. 2, to the inner periphery of circular openings 46, 48 and 47, 49 in outer and inner cylinders 16 and 18. However, it is recognized that these baffles may be shortened or extended, for instance to the tube sheets 22 and 24, therefore extending the baffles to axial positions B—B in FIG. 2. It is also understood that the helix angle of either or both the tubes or baffles can be optimized for any given design or can be varied axially in a particular exchanger to better satisfy the requirements.

Furthermore, it is understood that the tube diameter, tube spacing, number of tubes, annulus inner and outer diameters, length and materials, when used in helical flow configurations as described herein, and the use of more than two fluids exchanging heat (more than one set of tubes and tube sheets) are included in the spirit and concept of this invention.

In the configuration of the preferred embodiment, the fluids flow in helical paths within a cylindrical annulus. This can be termed an axial flow type of this embodiment. However, the advantages of obtaining a pure counterflow temperature distribution using cross flow can also be realized in spirally shaped tubes and baffles as shown in FIG. 6. This configuration is a spiral embodiment of the invention.

FIG. 6 shows one side of a heat exchanger 62, which is formed of two concentric cylinders or shells comprised of outer cylindrical shell 64 and inner cylindrical shell 66, defining an annular space or annulus 68 between the two cylinders. In the annulus 68 are positioned a number of spaced spirally extending tubes 70 which extend from and through the outer cylinder 64 to and through the inner cylinder 66. Also within the annulus 68 are positioned a plurality of spirally extending baffles 72 positioned across the tubes 70. Hot tube-side fluid flows through inlet 74 into a tube-side circular inlet manifold 76 positioned around the outer shell 64, from which the fluid passes into and through the tubes 70 into a circular tube-side outlet manifold 78 disposed around the inner periphery of inner shell 66, and the resulting cooled fluid is removed via a tube-side fluid outlet 80.

Cool shell-side fluid is introduced at 82 into the annular space 68 closely adjacent the outer surface of the inner cylinder or shell 66. The shell-side fluid then passes spirally outward through passages 83 between adjacent baffles 72 and across the tubes in heat exchange relation therewith, and in a radially opposite direction from the tube-side fluid, and the resulting shell-side fluid of increased temperature is then removed at 84 from the annular space 68, closely adjacent the outer shell 64. Shell side inlet manifold 86 distributes shell side fluid to the shell side entrance 82 from the shell side supply duct 88. Similarly, shell side outlet manifold 90 collects fluid emerging from the annulus 68 through exit 84 and delivers it to the shell side exit duct 92. Shell side inlet and exit manifolds may be employed at either or both sides of the heat exchanger 62 as appropriate to the application.

From the foregoing, it is seen that the present invention provides a unique heat exchanger having curved surfaces, e.g. as provided by cylindrical outer and inner shells, and which embodies means for passing heat exchange fluids in curved paths such as helical paths or spiral paths within a cylindrical annulus and affording efficient cross counterflow of heat exchange fluids with minimum pressure drop.

The heat exchanger configuration of the invention is particularly adapted and designed for use as a wrap-around regenerator for a gas turbine engine, or as a heat exchanger in conjunction with a turboexpander device. Thus, the helix-type exchanger of the invention could surround the turbomachine, which would be positioned within the inner cylindrical space or shell of the exchanger.

Since various further modifications of the invention will occur to those skilled in the art, the invention is not to be taken as limited except by the scope of the appended claims.

What is claimed is:

1. A cross-counterflow heat exchanger which comprises means forming an annulus, a system of curved tubes in said annulus, and a system of curved baffles in said annulus, said baffles crossing said tubes, whereby heat exchange fluids in said tubes and within said baffles flow in a curved path through said tubes and in a curved crossing path defined by said baffles within said annulus, in counter-flow heat exchange relation and in opposite directions.

2. The heat exchanger of claim 1, said system of curved tubes being helically extending tubes and said system of curved baffles being helically extending in a direction opposite to said tubes.

3. The heat exchanger of claim 1, said system of curved tubes being spirally extending tubes, and said system of curved baffles being spirally extending in a direction opposite to said tubes.

4. The heat exchanger of claim 1, said means forming said annulus comprised of an outer cylindrical shell and an inner cylindrical shell, said shells being concentric.

5. The heat exchanger of claim 1, said means forming said annulus comprised of an outer barrel shaped shell and an inner barrel shaped shell, said shells being concentric.

6. A cross-counterflow heat exchanger which comprises means forming a substantially cylindrical annulus, a plurality of tubes extending helically in said annulus to permit flow of a first heat exchange fluid in one direction helically around the axis of said cylindrical annulus, and a plurality of spaced baffles positioned to constrain flow of a second heat exchange fluid helically across said tubes in an opposite direction around the axis of said cylindrical annulus.

7. The heat exchanger of claim 6, said means forming said annulus comprising a pair of inner and outer concentric cylinders, and including a pair of parallel tube sheets mounted at opposite ends of said concentric cylinders, said tubes attached at opposite ends to said tube sheets, and including a tube-side inlet manifold for said first fluid communicating with one of said tube sheets, and a tube-side outlet manifold for said first fluid in communication with the other tube sheet.

8. The heat exchanger of claim 7, including a shell-side inlet manifold for said second fluid communicating with said cylindrical annulus at one end thereof, and a shell-side outlet manifold for said second fluid communicating with said annulus at the opposite end thereof.

9. The heat exchanger of claim 8, including an inlet duct for delivering said first fluid to said tube-side inlet manifold and an outlet duct for removing said first fluid from said tube-side outlet manifold, and an inlet duct for delivering said second fluid to said shell side inlet manifold and an outlet duct for removing said second fluid from said shell-side outlet manifold.

10. The heat exchanger of claim 9, said shell-side inlet manifold comprising inner and outer shell-side manifold members, and said shell-side outlet manifold comprising inner and outer shell-side manifold members.

11. A cross-counterflow heat exchanger which comprises a pair of concentric inner and outer cylinders forming a cylindrical annulus between said cylinders, a pair of parallel ring-shaped tubesheets mounted adjacent opposite ends of said cylinders and adjacent the ends of said cylindrical annulus, a plurality of helically extending tubes mounted in said annulus, said tubes being attached and sealed at opposite ends to said tubesheets, to permit flow of a first heat exchange fluid in one direction helically around the axis of said cylindrical annulus, a plurality of spaced parallel baffles extending helically across said tubes in said annulus and positioned to constrain flow of said second fluid helically across said tubes in an opposite direction around the axis of said cylindrical annulus, said baffles having a depth extending across the annulus between said concentric cylinders, and extending substantially from one end of said annulus to the opposite end thereof, a tube-side inlet manifold for said first fluid communicating with one of said tube sheets, and a tube-side outlet manifold for said first fluid in communication with the other tube sheet, a shell-side inlet manifold for said second fluid communicating with said cylindrical annulus at one end thereof, and a shell-side outlet manifold for said second fluid communicating with said annulus at the opposite end thereof.

12. The heat exchanger of claim 11, said tube-side inlet manifold being ring-shaped and positioned around the outside of said one of said tube sheets and said tube side outlet manifold being ring-shaped and positioned around the outside of said other tubesheet.

13. The heat exchanger of claim 12, said shell side inlet manifold comprising inner and outer manifold members, each of said manifold members being ring shaped and positioned around the inner and outer periphery of said tubesheet adjacent the tube side outlet manifold, said inner manifold member communicating with said annulus through a peripheral opening between said tubesheet and said inner cylinder and said outer manifold member communicating with said annulus through a peripheral opening between said tubesheet and said outer cylinder.

14. The heat exchanger of claim 13, said shell side outlet manifold comprising inner and outer manifold members, each of said manifold members being ring shaped and positioned around the inner and outer periphery of said tubesheet adjacent the tube side inlet manifold, said inner manifold member communicating with said annulus through a peripheral opening between said tubesheet and said inner cylinder and said outer manifold member communicating with said annulus through a peripheral opening between said tubesheet and the outer cylinder.

15. The heat exchanger of claim 14, including an inlet duct for delivering said first fluid to said tube-side inlet manifold and an outlet duct for removing said first fluid from said tube-side outlet manifold, and an inlet duct for delivering said second fluid to the inner and outer manifold members of said shell-side inlet manifold and an outlet duct for removing said second fluid from the inner and outer manifold members of said shell side outlet manifold.

16. A cross-counterflow heat exchanger which comprises a pair of concentric inner and outer cylinders forming an annulus between said cylinders, a plurality of spirally extending tubes in said annulus extending from the outer cylinder to the inner cylinder, to permit flow of a first heat exchange fluid in one direction spirally within said annulus, a plurality of spaced baffles extending spirally across said tubes in said annulus and positioned to constrain flow of said second fluid spirally across said tubes in a radially opposite direction from said first fluid, a tube-side inlet manifold for said first fluid in communication with one end of said tubes, a tube-side outlet manifold in communication with the other end of said tubes, means for introducing said second fluid in said annulus between said baffles adjacent said tube-side outlet manifold, and means for removing said second fluid from said annulus adjacent said tube-side inlet manifold.

17. The heat exchanger of claim 16, said tube-side inlet manifold being circular and positioned around the outer periphery of said outer cylinder, said tube-side outlet manifold being circular and positioned around the inner periphery of said inner cylinder, and including a tube-side fluid inlet to said tube-side inlet manifold, and a tube-side fluid outlet from said tube-side outlet manifold.

18. The heat exchanger of claim 16, said means for introducing said second fluid in said annulus including a shell-side fluid inlet manifold around the periphery of said inner cylinder and a shell-side fluid inlet to said last mentioned manifold, and said means for removing said second fluid from said annulus including a shell-side fluid outlet manifold around the periphery of said outer cylinder and a shell-side fluid outlet from said last mentioned manifold.

* * * * *